US009421419B1

(12) United States Patent
Goldberg

(10) Patent No.: US 9,421,419 B1
(45) Date of Patent: Aug. 23, 2016

(54) FINGER/HAND EXERCISER

(71) Applicant: Elliott Goldberg, Scarsdale, NY (US)

(72) Inventor: Elliott Goldberg, Scarsdale, NY (US)

( * ) Notice: Subject to any disclaimer, the term of this patent is extended or adjusted under 35 U.S.C. 154(b) by 0 days.

(21) Appl. No.: 14/518,448

(22) Filed: Oct. 20, 2014

(51) Int. Cl.
*A63B 23/16* (2006.01)
*A63B 21/02* (2006.01)

(52) U.S. Cl.
CPC ..... *A63B 23/16* (2013.01); *A63B 21/023* (2013.01)

(58) Field of Classification Search
CPC ..... A63B 23/16; A63B 21/1449; A63B 21/1438; A63B 23/14; A63B 2071/0655; A63B 23/00
USPC ..... 482/47
See application file for complete search history.

(56) References Cited

U.S. PATENT DOCUMENTS 1,136,481 A * 4/1915 Ostrovsky ..... G09B 15/06 482/47
1,796,216 A * 3/1931 Pettersson ..... A63B 23/16 482/47
2,118,684 A * 5/1938 Prescott ..... A63B 23/16 482/13
3,447,415 A * 6/1969 Kime ..... G09B 15/06 267/177
3,738,651 A * 6/1973 Norman ..... A63B 23/16 482/128
4,350,335 A * 9/1982 Pasbrig ..... A63B 23/16 482/128
4,678,181 A * 7/1987 Ditsch ..... A63B 23/16 482/128
5,147,256 A 9/1992 Silagy
D352,754 S 11/1994 Silagy
5,431,611 A * 7/1995 Silagy ..... A63B 23/16 482/122
5,690,585 A * 11/1997 Ditsch ..... A63B 23/16 482/121
7,967,732 B2 6/2011 D'Addario et al.
9,005,084 B2 * 4/2015 Silagy ..... A63B 21/023 482/44
2009/0318269 A1 * 12/2009 D'Addario ..... A63B 21/023 482/47
2010/0279826 A1 * 11/2010 Weinstock ..... A63B 23/16 482/47
2014/0135179 A1 * 5/2014 Trent ..... A63B 23/16 482/47

* cited by examiner

*Primary Examiner* — Stephen Crow
*Assistant Examiner* — Andrew S Lo
(74) *Attorney, Agent, or Firm* — Weiner & Burt, P.C.; Irving M. Weiner; Pamela S. Burt

(57) ABSTRACT

A hand and finger exerciser apparatus having a base unit structure, resiliently-biased slidable finger button devices, and a mechanism for selectively locking and unlocking the finger button devices. Each finger button device can be used independently to exercise fingers, or compress the entire unit for complete hand and forearm strengthening.

10 Claims, 6 Drawing Sheets

FINGER/HAND EXERCISER

The present invention relates generally to improvements for a hand and finger exerciser apparatus of the type in which engaged elements or components are pressed against the resistance or urgence of resilient members, wherein the user is given the option of exercising selected individual fingers or the entire hand.

More particularly, the present invention relates a hand and finger exerciser apparatus as described hereinabove, wherein the apparatus includes components for selectively locking and unlocking one or more finger button devices.

BACKGROUND OF THE INVENTION

Routines contemplating the exercising of fingers against the resistance of springs are embodied in the construction and operational mode of prior art hand exercising devices, as exemplified by the hand exercising device illustrated and described in U.S. Pat. No. 3,738,651 issued to Donald Norman on Jun. 12, 1973 for "Finger, Hand And Forearm Developer".

It is a desideratum of the present invention to avoid the animadversions of conventional finger/hand exercisers, and to provide an apparatus which can be used to independently exercise fingers or compress the entire apparatus for complete hand and forearm strengthening.

SUMMARY OF THE INVENTION

The present invention provides a hand and finger exerciser apparatus, comprising: abase unit structure; a plurality of movable finger button devices; first means for slidably connecting said plurality of finger button devices to said base unit structure; second means for selectively locking and unlocking an associated finger button devices; said second means being operably connected to said base unit structure and to said first means; said first means and said second means being configured to permit selective locking and unlocking of an associated finger button device upon pressing associated second means; and third means, operatively connected to said base unit structure, said movable finger button devices and said first means, for providing resistance to moving of the finger button in a first direction from a first position and for urging the finger button to move in a second direction back to said first position.

It is an object of the present invention to provide an improved apparatus as described hereinabove, wherein each finger button device can be used independently to exercise fingers, or to compress the entire unit for complete hand and forearm strengthening.

Another object is to provide an apparatus as described hereinabove, wherein each said movable finger button device includes therewithin said third means having a first predetermined resistance.

Another object is to provide an apparatus as described hereinabove, wherein said third means includes a device selected from a group consisting of a spring device, a magnetic device, a resilient device, and a circumferential pressure device.

Another object is to provide an apparatus as described hereinabove, wherein the exercising use of the apparatus provides the user with the option of individual finger exercise routines, or an entire hand exercising routine.

Another object is to provide an apparatus as described hereinabove, wherein the second means for selectively locking and unlocking the finger button device are diametrically-opposed on opposite sides of the finger button device.

Another object is to provide an apparatus as described hereinabove, wherein: the second means for selectively locking and unlocking the resiliently-biased finger button device are diametrically-opposed on opposite sides of the finger button device; and said second means moves relative to said body unit structure perpendicular to a major elongated central axis of the finger button device to selectively and releasably lock or unlock the finger button device.

Other objects, advantages, and features of the present invention will become apparent to those persons skilled in this particular area of technology and to other persons after having been exposed to the present patent application when read in conjunction with the accompanying patent drawings.

DETAILED DESCRIPTION OF THE INVENTION

Figure 1:
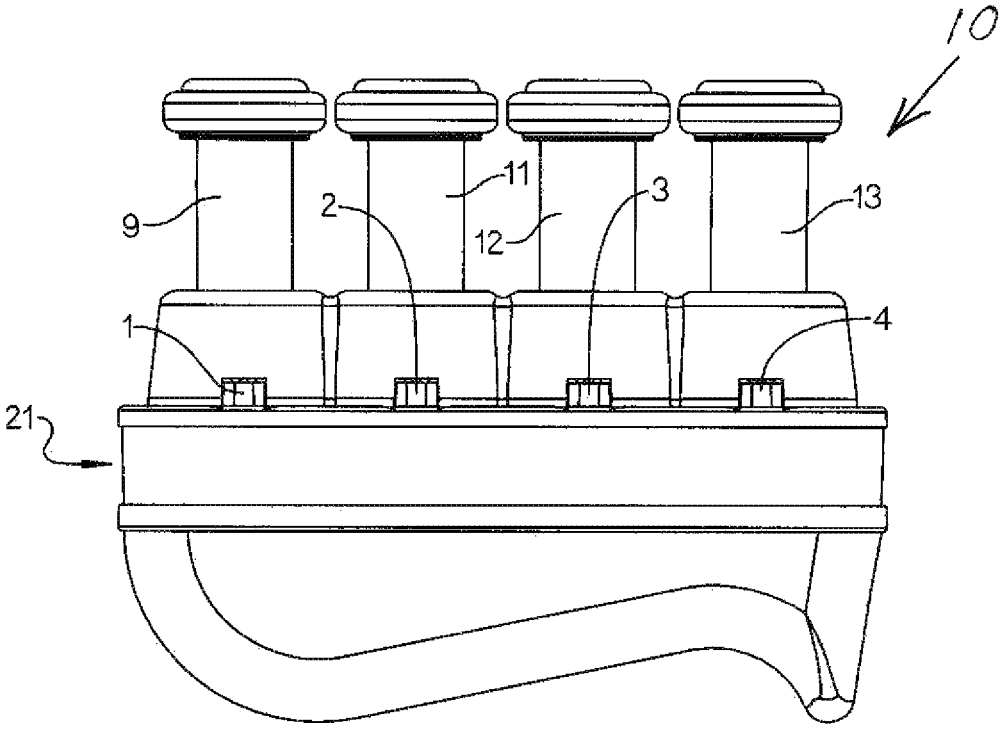
FIG. 1 is a front elevation of a first embodiment of the invention.
Figure 2:
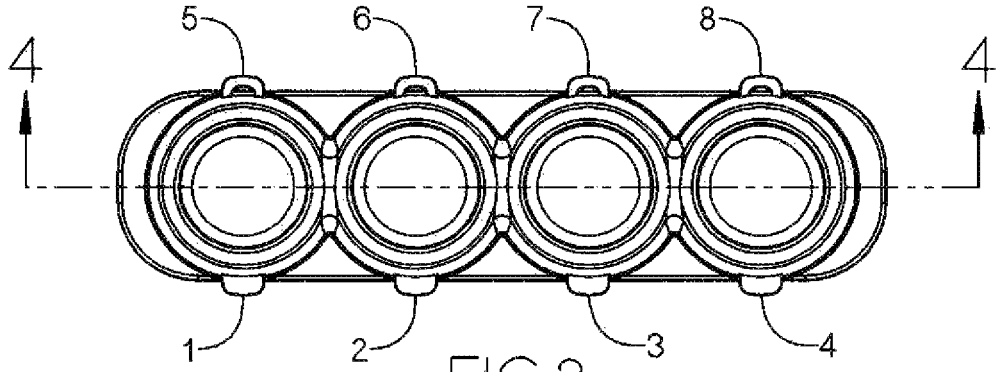
FIG. 2 is a top plan view of the FIG. 1 apparatus.
Figure 3:
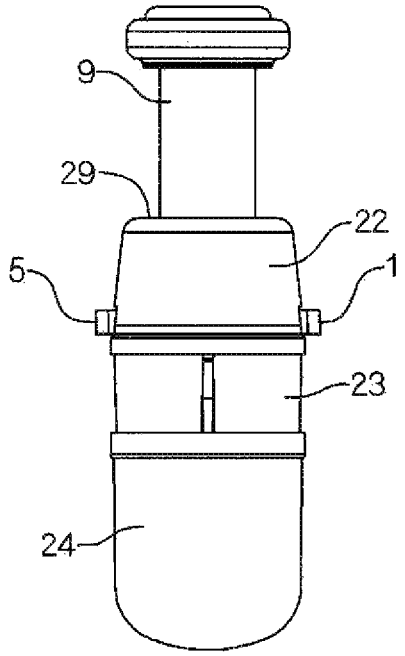
FIG. 3 is a left end view thereof.

With reference to the drawings, there is shown a first embodiment of the hand and finger exerciser apparatus 10.

The apparatus 10 includes a base unit structure 21.

The apparatus 10 further includes a plurality of resiliently-biased finger button devices 9, 11, 12 and 13.

The resilience and resistance of the devices 9, 11, 12 and 13 can be from a spring 25, 26, 27 or 28, respectively, or other devices.

The apparatus 10 also includes first means for slidably connecting the plurality of finger button devices 9, 11, 12 and 13 to the base unit structure 21.

The apparatus 10 further includes second means 1, 2, 3, 4, 5, 6, 7 and 8 for selectively locking and unlocking the plurality of finger button devices 9, 11, 12 and 13.

The second means 1, 2, 3, 4, 5, 6, 7 and 8 are operably connected to the base unit structure 21 and to the first means.

The second means can be located on one side of the apparatus 10, on both sides thereof, and can be a toggle, slide or other mechanism.

The first means and the second means 1, 2, 3, 4, 5, 6, 7 and 8 are configured to permit selective locking and unlocking of an associated finger button device 9, 11, 12 and 13, respectively, upon pressing or moving the second means.

As best seen in FIGS. 1, 3, 4 and 5, the base unit structure 21 of the optional individual finger or entire hand exerciser apparatus 10 is comprised of an operative arrangement of three cooperating body members, namely an upper body member 22, a middle or centrally disposed body member 23, and a lower body member 24.

The four adjacent individually independently-slidable finger button devices 9, 11, 12 and 13 are slidably positioned in the base unit structure 21.

Each one of the four adjacent individually-independently slidable finger button devices 9, 11, 12 and 13 is provided with an enlarged upper portion 20.

The finger button devices 9, 11, 12 and 13 can be provided with completely-enclosed springs 25, 26, 27 and 28, respectively, or other types of suitable resilient resistance members.

Figure 5:
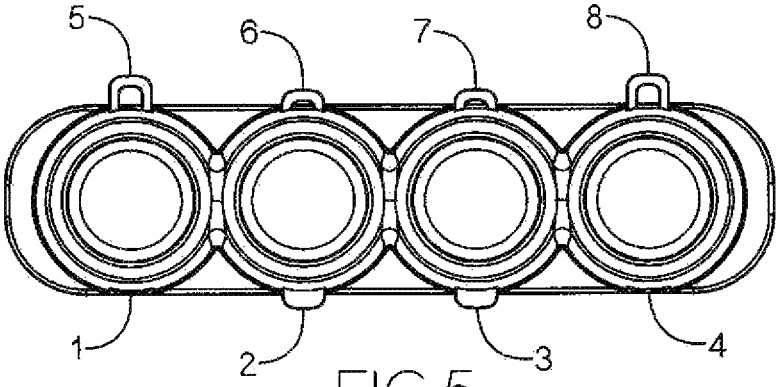
FIG. 5 is a view similar to FIG. 2 but with two finger button devices locked.

The locked position of finger button devices 9 and 13 is illustrated in FIG. 5.

In the unlocked position (as illustrated in FIGS. 1, 2, 3 and 4), each on of the finger button device 9, 11, 12 and 13 extends a predetermined distance above the upper surface 29 of the upper body member 22.

Figure 4:
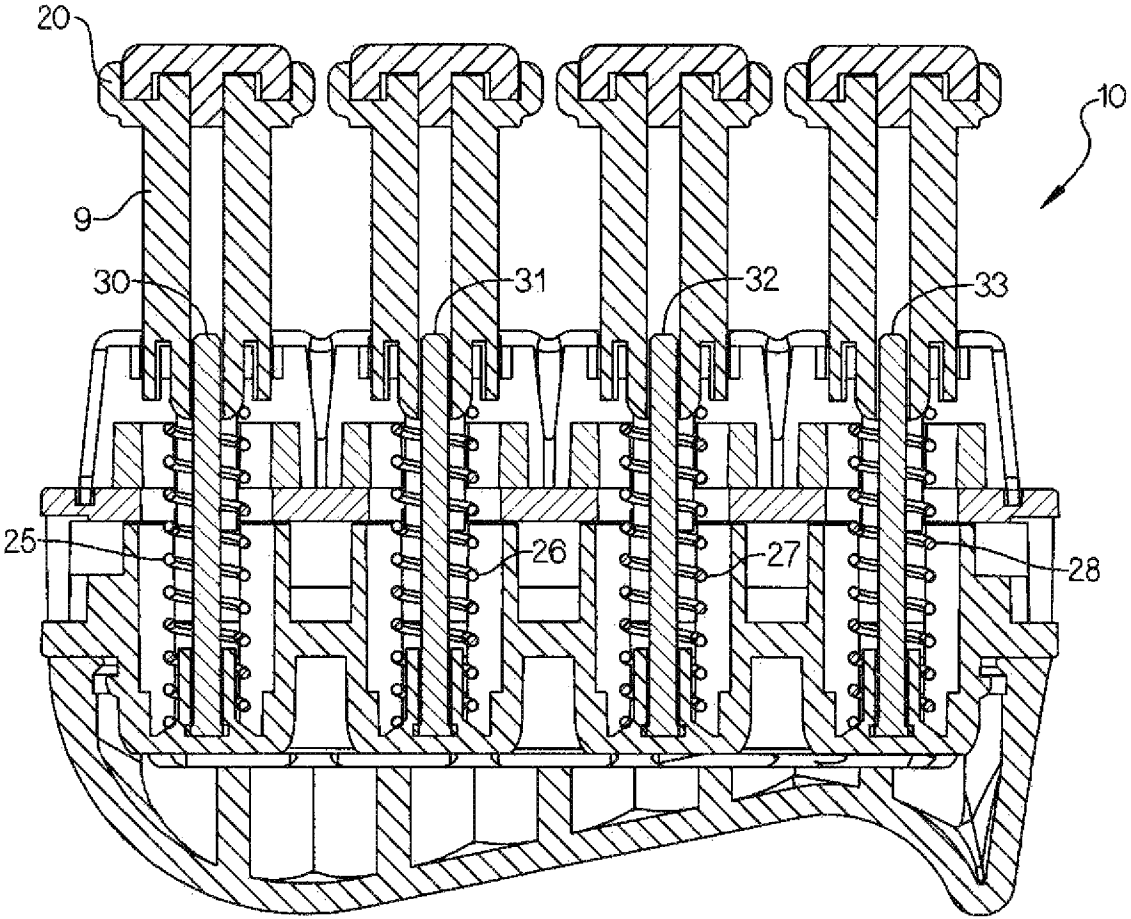
FIG. 4 is a sectional view taken along line 4-4 of FIG. 2.
Figure 6:
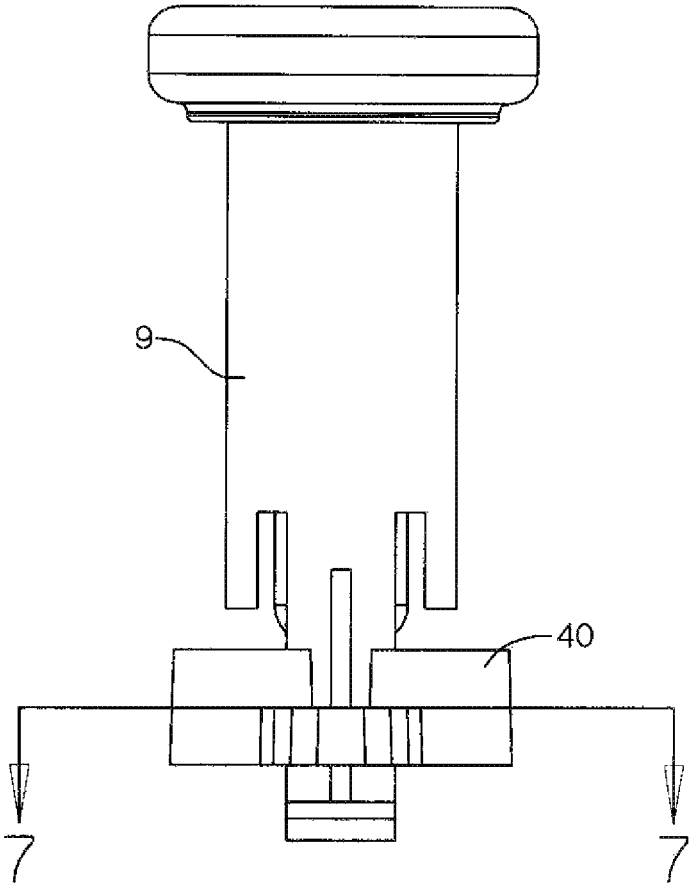
FIG. 6 is a view of a finger button device and cooperating parts.

As illustrated best in FIG. 4, a set of four guide pins 30, 31, 32 and 33 are arranged to be located axially within a cooperating one of the helical springs 25, 26, 27 and 28, respectively, which are disposed in encircling relation about its associated guide pin.

Each finger button device 9, 11, 12 and 14 is provided with individual, diametrically-opposed, finger locking/unlocking members 1/5, 2/6, 3/7 and 4/8, respectively, which members form part of an associated slidable component 40 that is best seen in FIGS. 6 through 12.

FIG. 4 illustrates the arrangement of the components when the independently-slidable spring-biased finger button devices 9, 11, 12 and 13 are in their unlocked position ready to be used for exercising.

The second means 1, 2, 3, 4, 5, 6, 7 and 8 for selectively locking and unlocking the finger button devices 9, 11, 12 and 13 are disposed diametrically-opposed on opposite sides of their associated finger button device.

The second means can be located on one side of the apparatus 10, on both sides thereof, and can be a toggle, slide or other mechanism The second means 1, 2, 3, 4, 5, 6, 7 and 8 moves relative to the body unit structure 21 perpendicular to a major elongated central axis of the finger button device to selectively and releaseably lock or unlock the finger button device.

This movement, unlocking and locking is best illustrated in FIGS. 6 through 12.

Figure 7:
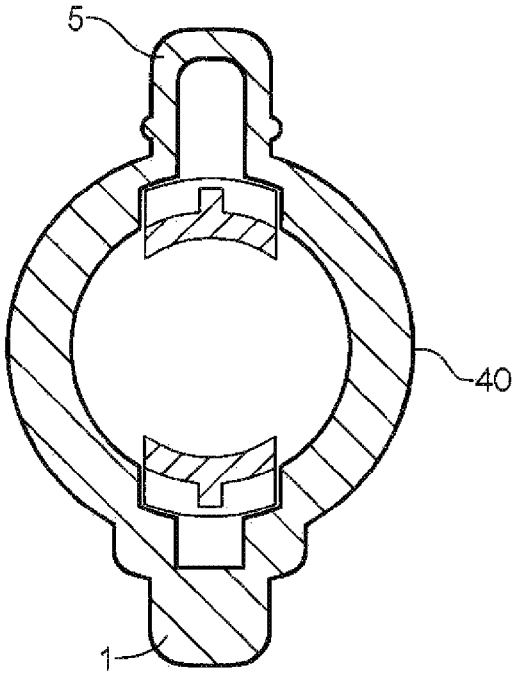
FIG. 7 is a sectional view taken along the line 7-7 of FIG. 6 showing the unlocked position.

In particular, FIG. 7 illustrates the unlocked position of the components.

Figure 8:
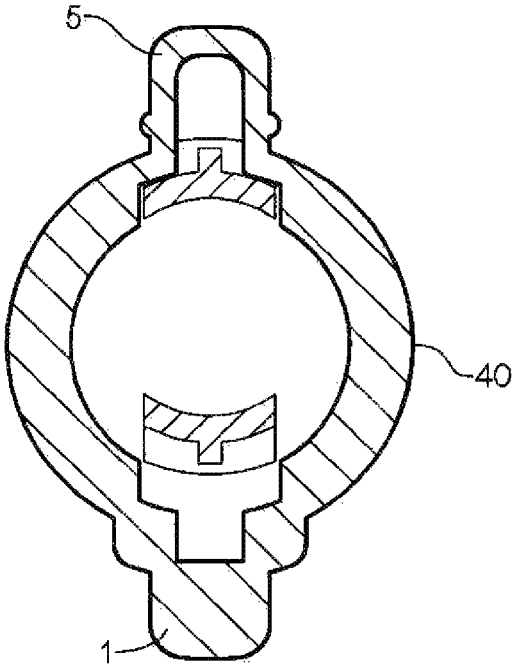
FIG. 8 is a view similar to FIG. 7 but showing the locked position.
Figure 9:
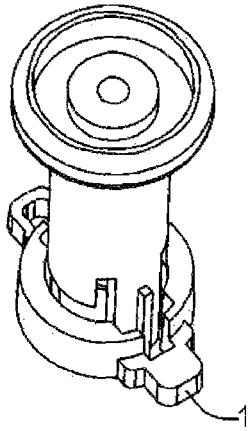
FIGS. 9-12 show perspective view of the parts depicted in FIGS. 6-8.
Figure 10:
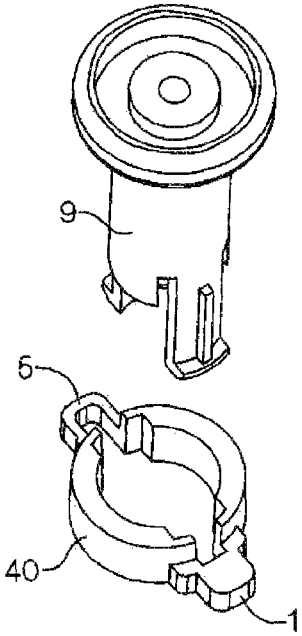
Figure 11:
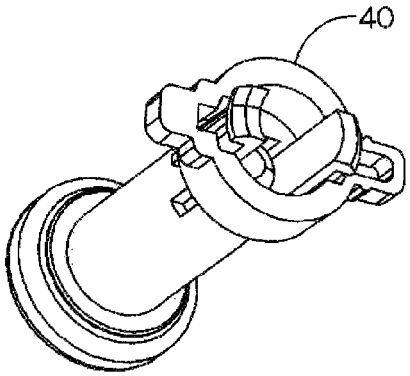
Figure 12:
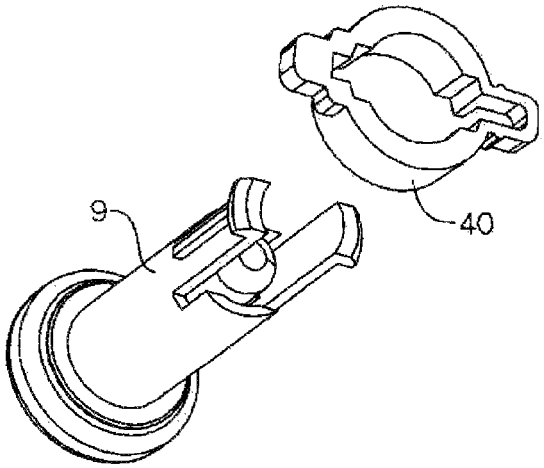

Furthermore, and in particular, FIG. 8 illustrates the locked position of the components.

FIGS. 9 through 12 illustrate the components in perspective views to show how the components are assembled for locking and unlocking movement relative to one another.

The apparatus 10 is used to develop isolated finger strength, flexibility and coordination as it builds hand and forearm strength.

Each finger button device 9, 11, 12 and 13 can individually be locked and unlocked.

Each finger button device 9, 11, 12 and 13 has a single spring 25, 26, 27 and 18, respectively, which is covered by an associated plastic sheath.

The resilience and resistance of the devices 9, 11, 12 and 13 can be from a spring 25, 26, 27 or 28, respectively, or other devices.

Each finger button device 9, 11, 12 and 13 can be used independently to exercise fingers, or compress the entire unit for complete hand and forearm strengthening.

The exercising use of the apparatus 10 provides the user with the option of individual finger exercise routines, or an entire hand exercising routine.

In the exercise of one or more individual fingers, but less than all of the fingers of the entire hand, a selected finger button device, such as finger button device 9 of FIG. 1, is depressed against the resistance of its cooperating spring 25, thus resulting in finger button device 9 being urged from an initial starting clearance position as illustrated in FIG. 1, to a position against the upper surface 29 of the upper body member 22.

During individual finger exercising using one or more fingers to depress the selected finger button devices 9, 11, 12 and/or 13 against its cooperating exercising spring of the set of four thereof, the thumb of the user is passive or active.

However, when the exerciser apparatus 10 is used for an entire hand exercise routine, the thumb of the user is active or passive, along with the four fingers.

In such an entire hand exercise routine, the thumb contacts the lower surface 34 of the lower body member 24.

While the finger and hand exerciser herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

The description of the invention set forth hereinabove, together with the accompanying drawings, should not be construed as limiting the invention to the example shown and described, because those skilled in the art to which this invention appertains may be able to devise other forms thereof within the ambit of the appended claims.

The invention claimed is:

1. A hand and finger exerciser apparatus, comprising:

a base unit structure;

a plurality of movable finger button devices;

first means for slidably connecting said plurality of finger button devices to said base unit structure;

second means operably connected to said base unit structure and to said first means;

said second means including a plurality of slidable components wherein each slidable component is operatively connected to an associated finger button device;

each slidable component has a first position permitting its associated finger button device to slide within said first means, and a second position preventing its associated finger button device from sliding within said first means;

each slidable component having a first protuberance exposed externally of said first means enabling an user to push said first protuberance moving the slidable component into said first position to selectively permit its associated finger button device to slide within said first means, and having a second protuberance exposed externally of said first means enabling the user to push said second protuberance moving the slideble component into said second position to selectively prevent its associated finger button device from sliding within said first means;

said finger button devices and said slidable components being configured so that when the slidable component is in said first position its associated finger button device can slide within said first means, and when the slidable component is in said second position said second position its associated finger button device is prevented from sliding within said first means; and third means, operatively connected to said base unit structure, said movable finger button devices and said first means, for providing resistance to moving of the finger button devices in a first direction from a first finger button device position, and for urging the finger button devices to move in a second direction back to said first finger button device position.

2. A hand and finger exerciser apparatus according to claim 1, wherein:

each said movable finger button device includes therewithin said third means having a first predetermined resistance.

3. A hand and finger exerciser apparatus according to claim 1, wherein:

said third means includes a device selected from a group consisting of a spring device, a magnetic device, a resilient device, and a circumferential pressure device.

4. A hand and finger exerciser apparatus according to claim 2, wherein:

said third means includes a device selected from a group consisting of a spring device, a magnetic device, a resilient device, and a circumferential pressure device.

5. A hand and finger exerciser apparatus according to claim 1, wherein:

said first and second protuberances are diametrically-opposed on opposite sides of the finger button device.

6. A hand and finger exerciser apparatus according to claim 4, wherein:

first and second protuberances are diametrically-opposed on opposite sides of the finger button device.

7. A hand and finger exerciser apparatus according to claim 1, wherein:

said first and second protuberances are diametrically-opposed on opposite sides of the finger button device; and said slidable component moves relative to said base unit structure perpendicular to a major elongated central axis of the finger button device between said first position permitting its associated finger button device to slide within said first means, and said second position preventing its associated finger button device from sliding within said first means.

8. A hand and finger exerciser apparatus according to claim 2, wherein:

said first and second protuberances are diametrically-opposed on opposite sides of the finger button device; and said slidable component moves relative to said base unit structure perpendicular to a major elongated central axis of the finger button device between said first position permitting its associated finger button device to slide within said first means, and said second position preventing its associated finger button device from sliding within said first means.

9. A hand and finger exerciser apparatus according to claim 3, wherein:

said first and second protuberances are diametrically-opposed on opposite sides of the finger button device; and said slidable component moves relative to said base unit structure perpendicular to a major elongated central axis of the finger button device between said first position permitting its associated finger button device to slide within said first means, and said second position preventing its associated finger button device from sliding within said first means.

10. A hand and finger exerciser apparatus according to claim 4, wherein:

said first and second protuberances are diametrically-opposed on opposite sides of the finger button device; and said slidable component moves relative to said base unit structure perpendicular to a major elongated central axis of the finger button device between said first position permitting its associated finger button device to slide within said first means, and said second position preventing its associated finger button device from sliding within said first means.

* * * * *